US010245756B2

(12) United States Patent
Johnston et al.

(10) Patent No.: US 10,245,756 B2
(45) Date of Patent: Apr. 2, 2019

(54) MOLD ASSEMBLY FOR CONCRETE PRODUCTS FORMING MACHINE

(71) Applicant: Columbia Machine, Inc., Vancouver, WA (US)

(72) Inventors: Llewellyn L. Johnston, Vancouver, WA (US); Stacy L. Gildersleeve, Woodland, WA (US)

(73) Assignee: COLUMBIA MACHINE, INC., Vancouver, WA (US)

( * ) Notice: Subject to any disclaimer, the term of this patent is extended or adjusted under 35 U.S.C. 154(b) by 447 days.

(21) Appl. No.: 14/991,648

(22) Filed: Jan. 8, 2016

(65) Prior Publication Data

US 2017/0197331 A1 Jul. 13, 2017

(51) Int. Cl.

| | |
|---|---|
| ***B28B 3/00*** | (2006.01) |
| ***B28B 7/00*** | (2006.01) |
| ***B28B 7/24*** | (2006.01) |
| ***B28B 15/00*** | (2006.01) |

(52) U.S. Cl.
CPC ..... *B28B 7/0097* (2013.01); *B28B 7/24* (2013.01); *B28B 15/005* (2013.01)

(58) Field of Classification Search
CPC ..... B28B 7/0014; B28B 3/02; B28B 5/04; B28B 7/0097; B28B 7/24; B28B 7/0094; B28B 3/022; B28B 7/02
See application file for complete search history.

(56) References Cited

U.S. PATENT DOCUMENTS 4,472,127 A * 9/1984 Cyriax ..... B29C 31/006 264/328.7
6,352,236 B1 * 3/2002 Aaseth ..... B28B 3/022 249/119

* cited by examiner

*Primary Examiner* — William P Bell
*Assistant Examiner* — Andrew L Swanson
(74) *Attorney, Agent, or Firm* — Schaffer IP Law, LLC

(57) ABSTRACT

A mold assembly for forming concrete products comprising a mold box having cavities for receiving and molding concrete products and a mounting bracket extension coupled to each side wall of the mold box and forming a lower mounting surface of the mold box. Die alignment holes are formed in an underside of each mounting bracket extension and are configured to receive alignment dowels extending upward from shelves of the concrete products forming machine on which the mold box sits. The mounting bracket extensions further include mold transfer locators formed on the underside inward of the die alignment holes so that they are exposed from below when the mold assembly sits on the shelves of the concrete products forming machine. These locators are configured to locate the mold assembly onto mold extractor arms when the mold assembly is lifted off of the alignment dowels by the mold extractor arms during a mold extraction process.

14 Claims, 8 Drawing Sheets

10

MOLD ASSEMBLY FOR CONCRETE PRODUCTS FORMING MACHINE

BACKGROUND OF THE INVENTION

1. Field of the Invention

This invention relates generally to concrete products forming machines (CPMs) and more particularly to mold assemblies used in such machines with particular features to assist in the mold change process.

2. Description of the Prior Art

Prior art machines for forming concrete products within a mold box include a product forming section comprising a stationary frame, an upper compression beam and a lower stripper beam. The mold assembly includes a head assembly that is mounted on the compression beam, and a mold box that is mounted on the frame and receives concrete material from a feed drawer. An example of such a system is shown in U.S. Pat. No. 5,807,591 which describes an improved concrete products forming machine (CPM) assigned in common to the assignee of the present application and herein incorporated by reference for all purposes.

In use, the feed drawer moves concrete material over the top of the mold box and dispenses the material into the contoured cavities of the mold box. The feed drawer typically includes an agitator assembly within the drawer that operates to break up the concrete and improve its consistency prior to dropping it into the mold. As the concrete material is dispensed, a vibration system shakes the mold box to spread the concrete material evenly within the mold box cavities in order to produce a more homogeneous concrete product. A wiper assembly, mounted to the front of the feed drawer, acts to scrape excess concrete from the shoes when the feed drawer is moved to an operative position above the mold box.

After the concrete is dispensed into the mold cavities, the feed drawer retracts from over the top of the mold box. A spreader, bolted separately to the front of the feed drawer, scrapes off excess concrete from the top of the mold when the feed drawer is retracted after filling the mold cavities. The compression beam then lowers, pushing shoes from the head assembly into corresponding cavities in the mold box. The shoes compress the concrete material during the vibration process. After compression is complete, the stripper beam lowers as the head assembly pushes further into the cavities against the molded material. A molded concrete product thereby emerges from the bottom of the mold box onto a pallet and is conveyed away for curing, and a new pallet moved in its place beneath the underside of the mold box.

The mold box and head assembly are matched together and configured to form concrete products in a specific shape, size, and number. Each product configuration requires a different mold. When the operator desires the CPM to produce products in different configurations, the mold assembly must be detached from mounts on the CPM and removed along with the assembly. A different mold box and head assembly must then be moved into place and mounted within the CPM.

Conventional methods for changing molds out in a CPM are typically labor intensive. This is further complicated when a mold of one product height is changed within a concrete products machine for a mold of a different product height, where manual intervention is required for setting various machine parameters. That is, the positioning and height of the parts within the machine must be manually adjusted to properly receive mold assemblies depending upon the height and configuration of the mold assembly received. All such activities result in additional downtime with the machine, leading to lost revenue.

Accordingly, there is need for an improved system and method for better automating the process for changing molds within a concrete products forming machine, and particularly a mold assembly construction that facilitates this mold change process and that minimizes these drawbacks.

SUMMARY OF THE INVENTION

A mold assembly for forming concrete products comprising a mold box having a body with a front wall and a back wall joined together with side walls and having cavities for receiving and molding the concrete products. The side walls each have a side face that spans between a bottom facing surface of the side face and a top facing surface. The front and back walls of the mold box are sized for extending substantially between a pair of shelves on a concrete product forming machine and allowing the mold box to sit directly on top of the shelves. The mold box including die alignment holes extending up from the bottom facing surface for slidingly receiving a respective alignment dowel extending up from the shelves thereby holding the mold box in a prealigned position before coupling the mold box to the shelves.

The mold assembly further includes a head assembly that includes multiple shoes shaped for slidingly inserting through a top side of the mold box into the cavities and for compressing the concrete products into a molding condition and pushing the molded concrete products out a bottom side of the mold box. The shoes are slidingly removable back out the top side allowing the mold box to receive and mold additional concrete products. Transfer stop brackets are downwardly directed from side walls of the head assembly, and configured to contact side walls of the mold assembly and suspend the shoes within the cavities at a designated lower height. Compression strip stop brackets on the mold assembly are downwardly directed from side walls of the head assembly and have a terminating lower surface disposed above and outside of the transfer stop brackets that is configured to contact a bumper surface on the concrete products machine prior to the transfer stop brackets contacting the mold box during a molding process.

Another aspect of the invention includes a mold assembly for forming concrete products comprising a mold box having cavities for receiving and molding concrete products and a mounting bracket extension coupled to each side wall of the mold box and forming a lower mounting surface of the mold box. Die alignment holes are formed in an underside of each mounting bracket extension and are configured to receive alignment dowels extending upward from shelves of the concrete products forming machine on which the mold box sits. The mounting bracket extensions further include mold transfer locators formed on the underside inward of the die alignment holes so that they are exposed from below when the mold assembly sits on the shelves of the concrete products forming machine. These locators are configured to locate the mold assembly onto mold extractor arms when the mold assembly is lifted off of the alignment dowels by the mold extractor arms during a mold extraction process.

Also disclosed is a process for forming concrete products using a mold box having cavities for receiving and molding concrete products and a head assembly having multiple shoes aligned within the mold box cavities and compression strip stops located outside the shoes. The process includes spanning the mold box across a pair of shelves on a concrete products forming machine and coupling the head assembly to a vertically moveable compression beam and lifting the head assembly from the mold box until the shoes are removed from the mold assembly cavities. The cavities are filled with concrete and the compression beam is lowered until the shoes are slidingly inserted into the cavities through a top side of the mold box. The shoes compress the concrete products into a molding condition and push the molded concrete products out a bottom side of the mold box. The shoes can then be slidingly withdrawn from the cavities back out the top side allowing the mold box to receive and mold additional concrete products lowering the shoes into the cavities. The lowering step is stopped when bottom surfaces of the compression strip stops contact stop block surfaces on the concrete products forming machine.

New and unique features of the invention include:

First, the mold box utilizes mold transfer locators for interfacing with the mold extractor assembly during transfer in and out of the concrete products forming machine.

Second, the mold head assembly incorporates transfer stops, and provision for tool less insertion of compression strip stops.

Third, contained within the mold assembly are components which, when transferred into the concrete products forming machine, allow for automatic positioning and height adjustment of the concrete products forming machine to change from one height of product to another height without external involvement.

The foregoing and other objects, features and advantages of the invention will become more readily apparent from the following detailed description of a preferred embodiment of the invention that proceeds with reference to the accompanying drawings.

DETAILED DESCRIPTION

Figure 1:
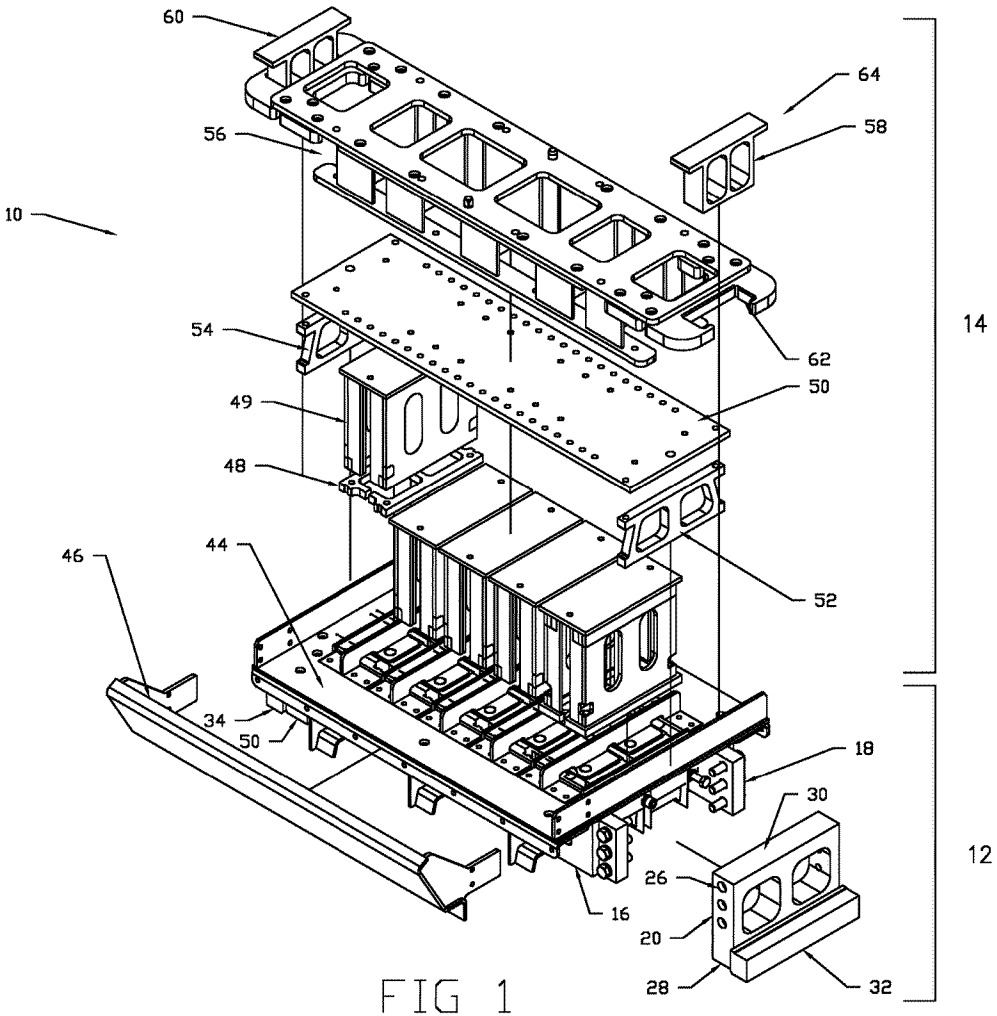
FIG. 1 is an exploded perspective view of a mold assembly constructed according to teachings of the invention.
Figure 2:
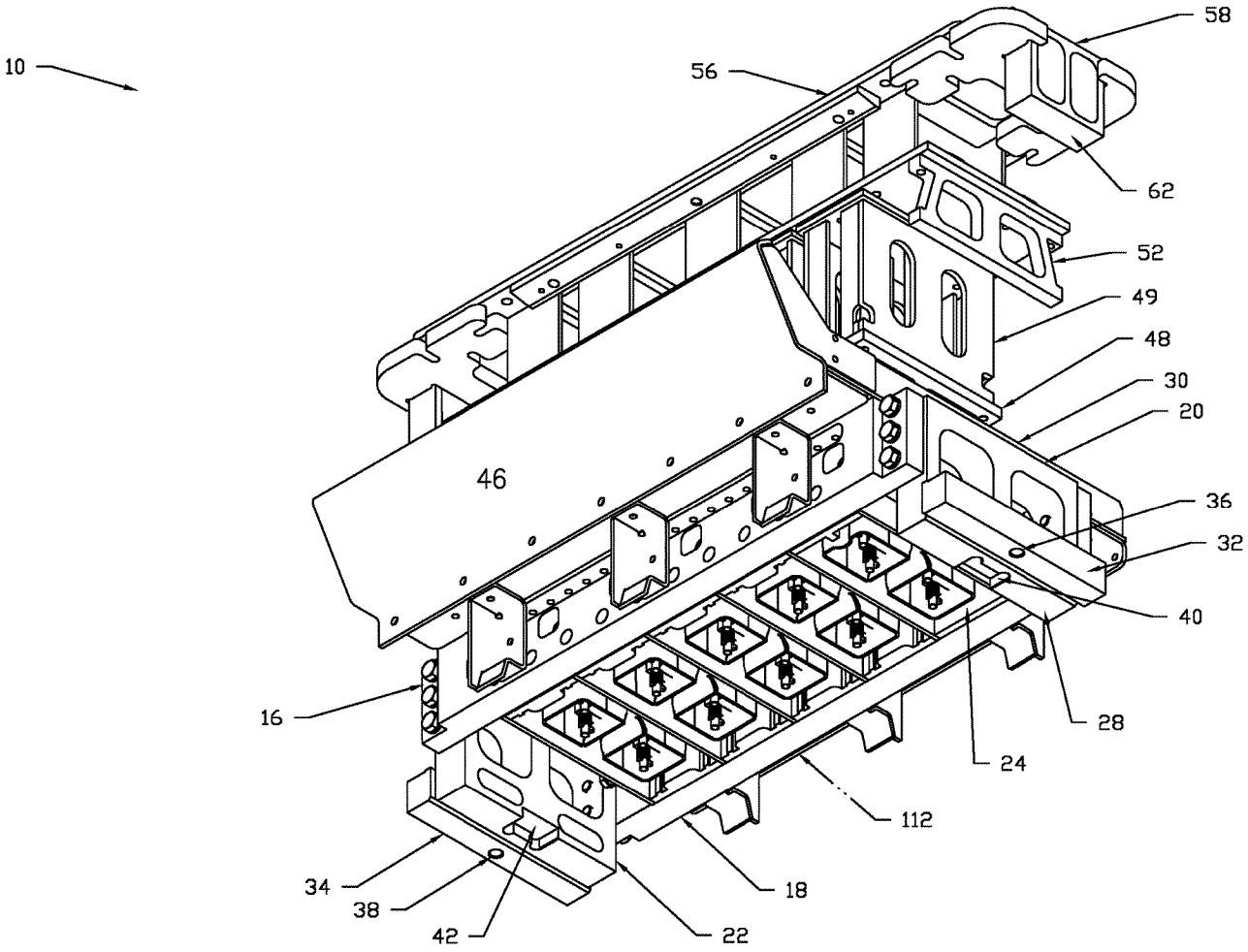
FIG. 2 is a perspective view of the mold assembly of FIG. 1 showing an underside thereof.
Figure 3:
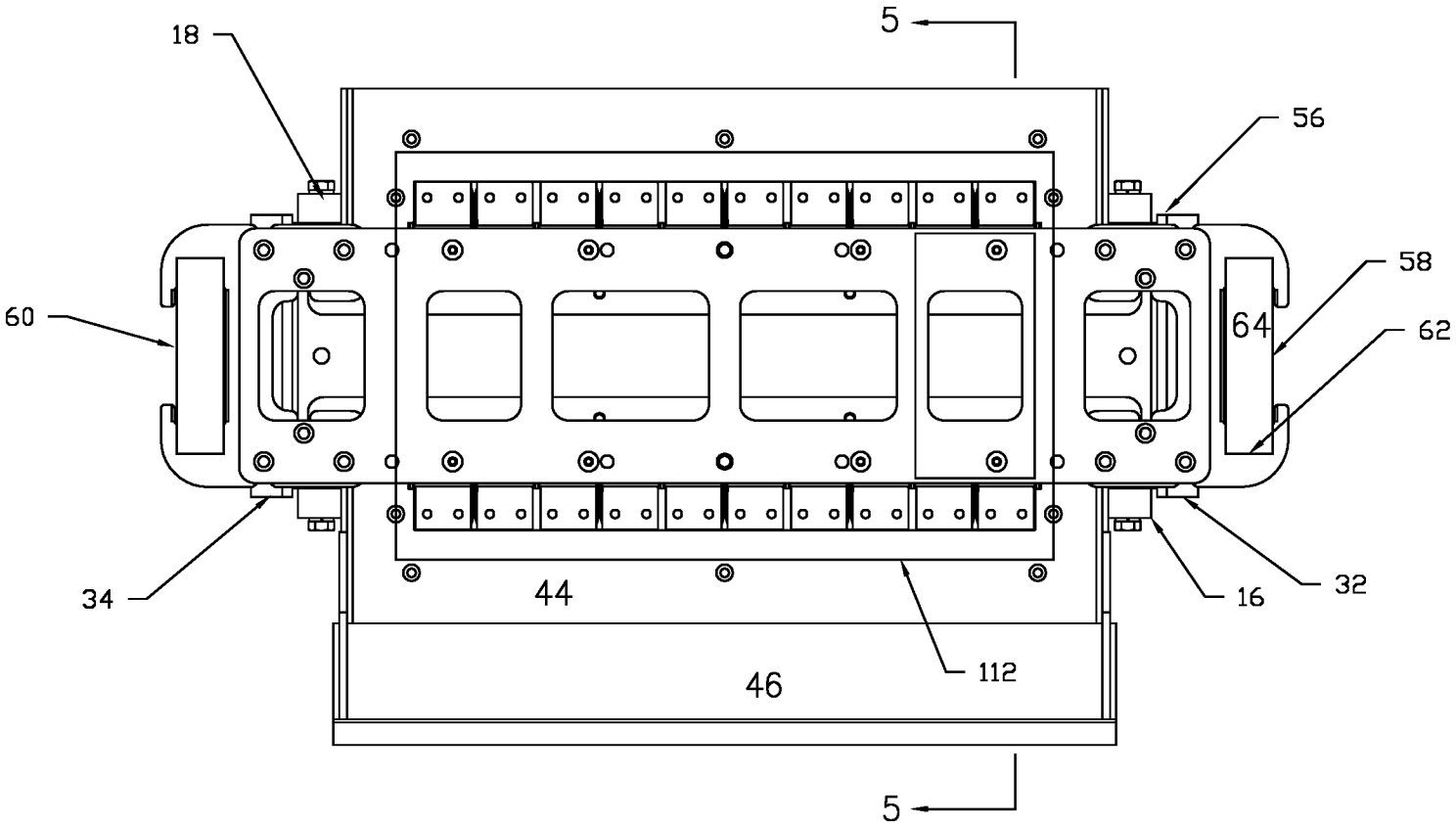
FIG. 3 is a top plan view of the mold assembly of FIG. 1.

FIG. 1 illustrates a mold assembly 10, and the component parts thereof, as constructed according to teachings of the invention. Mold assembly includes a mold box portion 12 and a head assembly portion 14 that are fitted together in alignment with one another for mounting together onto a concrete products forming machine as described further below. Assemblies 12 and 14 are constructed to form mold concrete products having a certain size and configuration, whereas different mold boxes can have differently configured assemblies resulting in different products. As the exchange of one mold assembly with another on a concrete products forming machine typically requires a large amount of manual labor and downtime, configuring the mold assembly to minimize each of these drawbacks is a key goal of the invention.

Turning also to FIGS. 2-5, mold box 12 includes a body with a front wall 16 and a back wall 18 joined together with side walls 20, 22 and having cavities, e.g. cavity 24 (FIG. 2), for receiving and molding the concrete products. The side walls 20, 22 each have a side face 26 that spans between a bottom facing surface 28 of the side face and a top facing surface 30.

A mounting bracket extension 32, 34 is coupled to each side wall 20, 22 of the mold box 12 to extend the width of the mold assembly 10. In use, and as shown in FIG. 6A, the front 16 and back 18 walls of the mold box 12 are sized for extending substantially between a pair of shelves on a concrete product forming machine—e.g. shelves 132 and 134 on CPM 100 (FIG. 6A)—to thus allow the mold box 12 to sit directly on top of and span between the shelves 132, 134. The mounting bracket extensions 32, 34 can be used to extend narrower mold boxes to mount to various CPMs, although such features may not be necessary if the bottom facing surfaces 28 of the sidewalls are wide enough to accommodate the die alignment and mold transfer features described further below. The mounting bracket extensions 32, 34 in combination with the side walls 20, 22 thus form the lower mounting surface of the mold assembly onto these shelves 132, 134 of the concrete products forming machine 100.

Formed in an underside of this lower mounting surface are die alignment holes 36, 38 adjacent an outer periphery of the mold box. When a mounting bracket extension 32, 34 is necessary for extending the width of the mold assembly 10, these die alignment holes 36, 38 are formed in each mounting bracket extension and configured to receive a respective alignment dowel 136 (FIG. 8) extending upward from the shelves of the concrete products forming machine.

Mold transfer locators 40, 42 are formed on the lower mounting surface of the mold box 12, inboard of the die alignment holes and shelves of the concrete products forming machine. In one embodiment, locators 40, 42 are recesses formed in the lower mounting surface that extend to an inner wall of the mold side walls 20, 22. Locators 40, 42 are configured to locate the mold assembly onto mold extractor arms when the mold assembly is lifted off of the alignment dowels by the mold extractor arms during a mold extraction process as described further below with reference to FIG. 8. In use, these mold transfer locators 40, 42 receive tapered alignment blocks formed atop the arms of the mold extraction device. The arms of the extraction device are configured to move between the CPM shelves 132, 134 and lift upward against the inward portion of the lower mounting surface of the mold box, this inward portion being that portion that does not sit directly atop the CPM shelves. The tapered alignment blocks are received within the mold transfer locators and the mold assembly 10 is lifted off of the shelves 132 134 for transport away from the CPM. A new mold assembly is then installed on the CPM in a reverse process and the production cycle is then restarted to form newly configured molded products.

A pan 44 sits atop mold box 12 and includes a front-mounted, upwardly-inclined pan front 46. When the head assembly 14 is lifted from the mold box 12, the mold upper openings of the mold cavities 24 are exposed. A feed drawer (not shown) is then moved over the top of the mold box and concrete is dropped into the mold cavities. Pan front 46 keeps the concrete from spilling out the front of the mold as the feed drawer is moved over the mold.

The head assembly 14 includes multiple shoes 48 shaped for slidingly inserting through a top side of the mold assembly 12 and into the mold cavities 24 coupled vertically with head leg 49. The shoes 48 compress the concrete products into a molding condition and push the molded concrete products out a bottom side of the mold box. The shoes 48 are then slidingly removable back out the top side allowing the mold assembly to receive and mold additional concrete products. A top-mounted connector plate 50 couples head legs 49 and the shoes 48 together in registry with the cavities of the mold assembly.

Downwardly directed transfer stop brackets 52, 54 are affixed on either side of the connector plate 50 width outside of the shoes 48. Stop brackets 52, 54 are configured to respectively contact a top surface of the side walls 30, 32 (see FIG. 4) when the mold box 10 is in a fully assembled condition for transport. When assembled in such a condition, the shoes 48 of the head assembly 14 are suspended within the mold cavities 24 at a designated lower height whereby at least a portion of the compression shoes are still retained within the bottom of the cavities so that the shoes are maintained in proper alignment with the cavities during transport.

The mold transfer stops 52, 54 are unique to the CPM mold described. They are permanently attached to the mold head assembly 14 but only contact the mold box 12 at time of mold transfer. They provide for holding the mold head assembly vertically and parallel in relationship to the bottom of the mold box as well as positioned accurately to center of mold box during transfer into and out of the CPM machine. The mold transfer stops are designed in such a way that they do not come into contact with the mold box during production cycle operation of the machine.

A head spacer 56 is affixed to the connector plate 50 to normalize the vertical height of the entire mold assembly 10. Compression strip stop brackets 58, 60 are downwardly directed from side walls of the head assembly 14 and have a terminating lower surface—e.g. lower surface 62 of bracket 58—disposed above and outside of the transfer stop brackets 52, 54. As explained further below, the transfer stop brackets 52, 54 are configured to contact a bumper surface on the concrete products machine prior to the transfer stop brackets contacting the mold box during a molding process. In a preferred implementation, this difference is around approximately ¾" and protects the mold during the repeated process of compressing the head assembly 14 into the mold box 12.

In a preferred construction of the mold assembly 10, the head assembly 14 (and more specifically the head spacer 56) includes slots 62 formed on outside upper surfaces thereof. These slots are located outside the width of the stop brackets 52, 54 as shown best in FIG. 6A. The compression strip stop brackets 58, 60 are slidably received in each of the slots 62 to enable tool less insertion and removal of the compression strip stop brackets from the head assembly. In this way, a library of stop brackets 58, 60 can be maintained separately from the mold assemblies and the proper sizes inserted during a production run. The compression strip stops are part of parts bin and can be reused in molds having the same product heights. The compression beam on the CPM is 33" from the pallet table surface, thus the distance between the bottom of the mounting bracket extension that sits on the die support shelves to the bottom of the compression strip stop is a fixed height. The head spacer 56 has provision for tool-less insertion of the compression strip stops 58, 60, offline, at the staging area of a mold transfer device and are transferred into the machine at the time of the mold assembly transfer. They are capable of being used from one mold to another with the same product height and are not a permanent component to every mold assembly In a preferred implementation, each of the compression strip stop brackets 58, 60 have an upper flared section 64 wider than the head assembly slots 62 so that the lower section inserts through the slot and the upper flared section sits atop the head assembly. Stop brackets 58, 60 are maintained within the slot during a production run when the head assembly is affixed to the compression beam as shown in FIG. 6A and described further below.

Figure 6B:
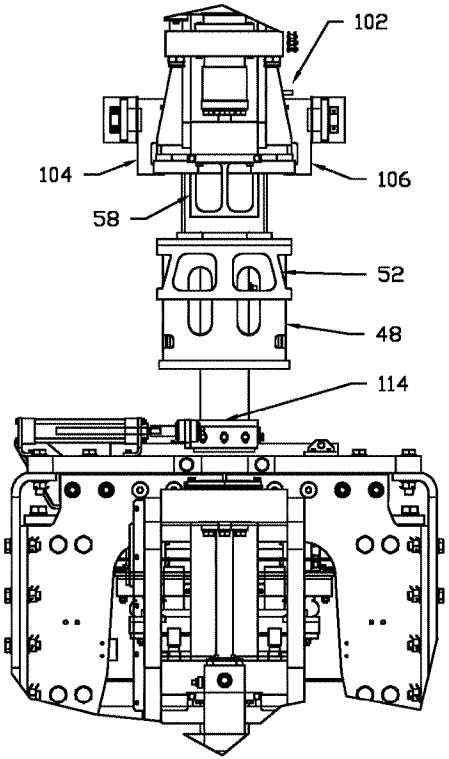
FIGS. 6A and 6B are front and side elevations, respectively, of the mold assembly of FIG. 1 mounted on a concrete products forming machine during a production cycle.
Figure 6A:
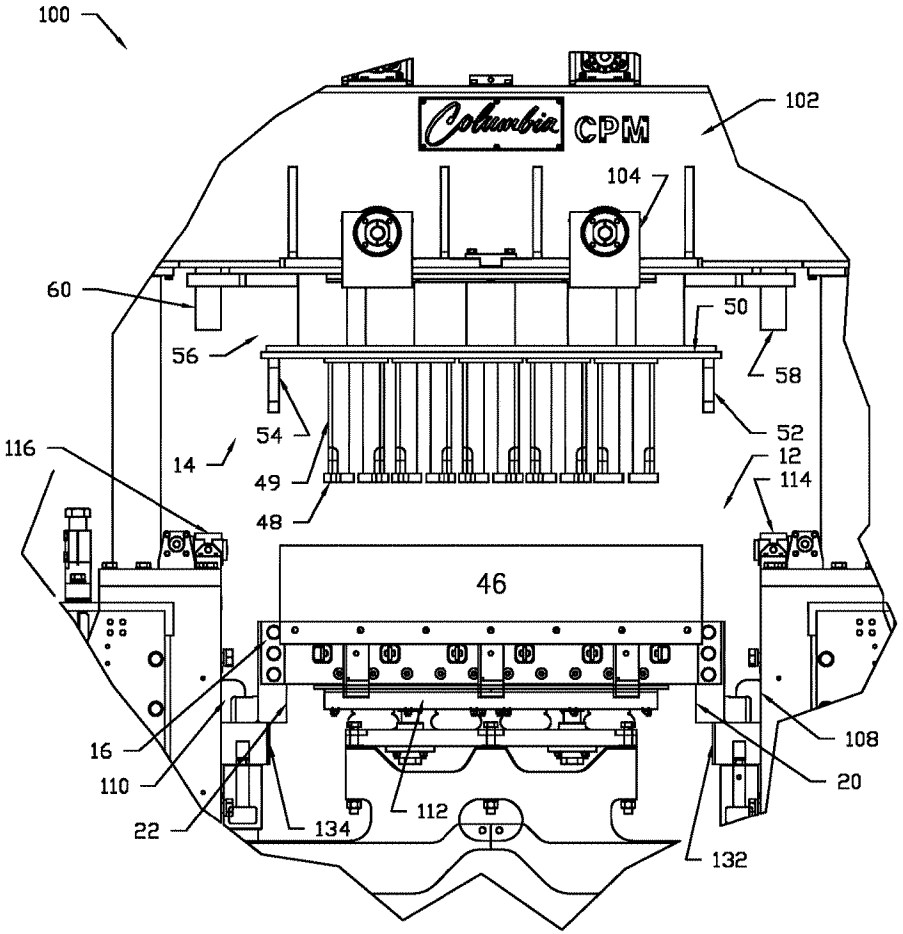

FIGS. 6A and 6B illustrates the mold assembly 10 as mounted within a concrete products forming machine 100. The front 16 and back 18 walls of the mold box 12 are sized for extending substantially between a pair of shelves on a concrete product forming machine—e.g. shelves 132 and 134 on CPM 100 (FIG. 6A)—allowing the mold box 12 to sit directly on top of the shelves.

A production run uses a mold box 12 having cavities 24 for receiving and molding concrete products, a head assembly 14 having multiple shoes 48 aligned within the mold assembly cavities, and compression strip stops 58, 60 located outside the shoes. The mold box 12 is spanned across a pair of shelves 132, 134 on concrete products forming machine 100.

Figure 7B:
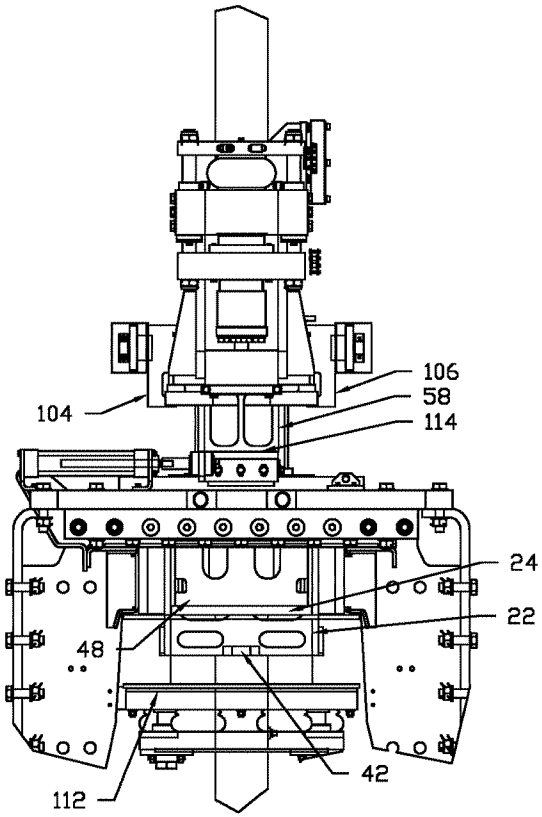
FIGS. 7A and 7B are front and side elevations, respectively, in partial section of the mold assembly of FIG. 1 mounted on a concrete products forming machine during a product-forming cycle with the shoes inserted into the mold cavities and pushing the molded product out.
Figure 7A:
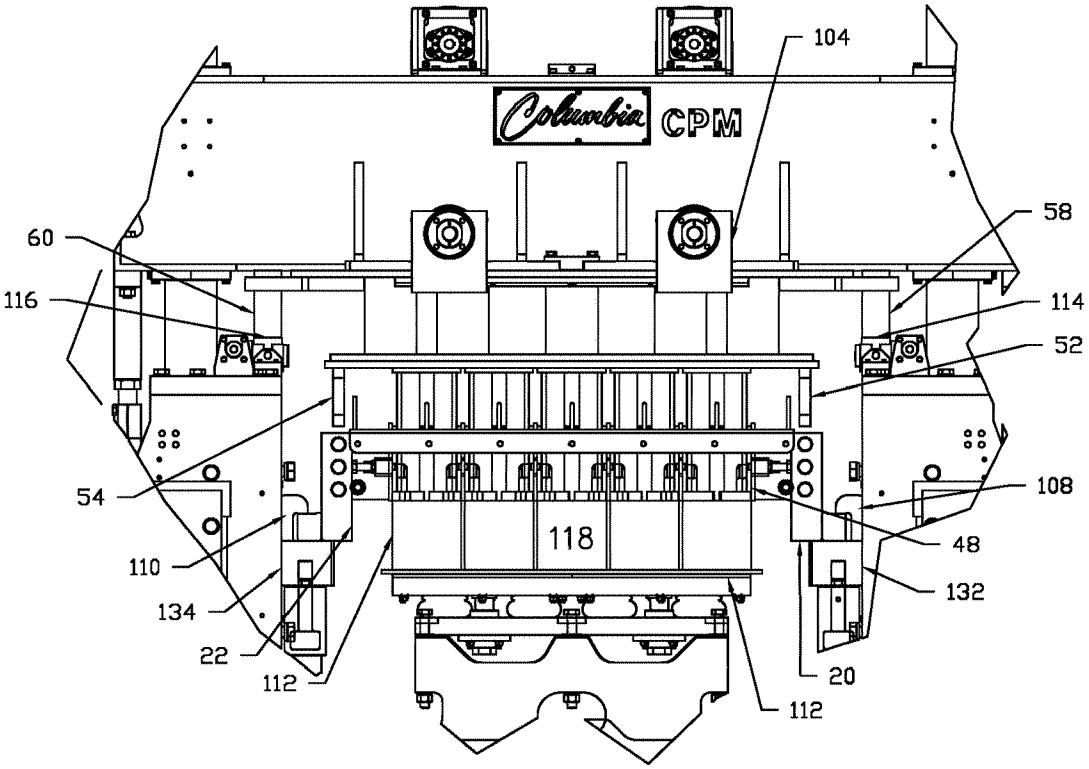

The head assembly 14 is then coupled to a vertically moveable compression beam 102, as via automated clamps 104, 106 (FIG. 6B), and lifted until the shoes 48 are removed from the mold box cavities 24 as shown in FIG. 6A. The mold box 12 is similarly coupled to the shelves via automated shelf clamps 108, 110 that raise and lower under computer control. A pallet 112 is then lifted against the underside of the mold cavities to prevent material from spilling out the mold box during a filling step. When the mold head assembly 14 is clamped onto the compression beam 102 of the CPM machine 100, the compression strip stops 58, 60 are firmly positioned to the underside of the compression beam to allow for rigid transfer of force from the compression beam to the stop blocks of the CPM machine In a next step, the cavities 24 of the mold box 12 are filled with concrete. As shown in FIGS. 7A and 7B, compression beam 102 is then lowered until the shoes 48 are slidingly inserted into the cavities 24 through a top side of the mold box 12. At this intermediate lowered position, the compression strip stop brackets 58, 60 make contact with stop blocks 114, 116 positioned on the CPM above and outside the shelves 108. 110. The lowering step is stopped when bottom surfaces of the compression strip stops 58, 60 contact stop block surfaces on the concrete products forming machine. The stop blocks 114, 116 are preferably topped by a rubber surface adapted to minimize the shock of contact with the stop brackets 58, 60 and of the head assembly 14 with the mold box 12. With the shoes 48 at the top of the mold box cavities and against the top of the concrete, the mold is vibrated by the CPM 100 to remove air pockets from within the molded product and to ensure that the concrete fills the entirety of the mold cavity for more uniform molded concrete products 118.

After lowering the head assembly to the intermediate lowered position, the head assembly and pallet 112 are lowered together. The shoes 48 thus continue to compress the concrete products into a molding condition and push the molded concrete products out a bottom side of the mold assembly until the molded concrete products are fully removed from the cavities and sitting upon the pallet 112. The pallet is then removed and a new one moved into position, the shoes 48 slidingly removable back out the top side of the mold cavities 24, and the production cycle continued to allow the mold box to receive and mold additional concrete products.

Figure 4:
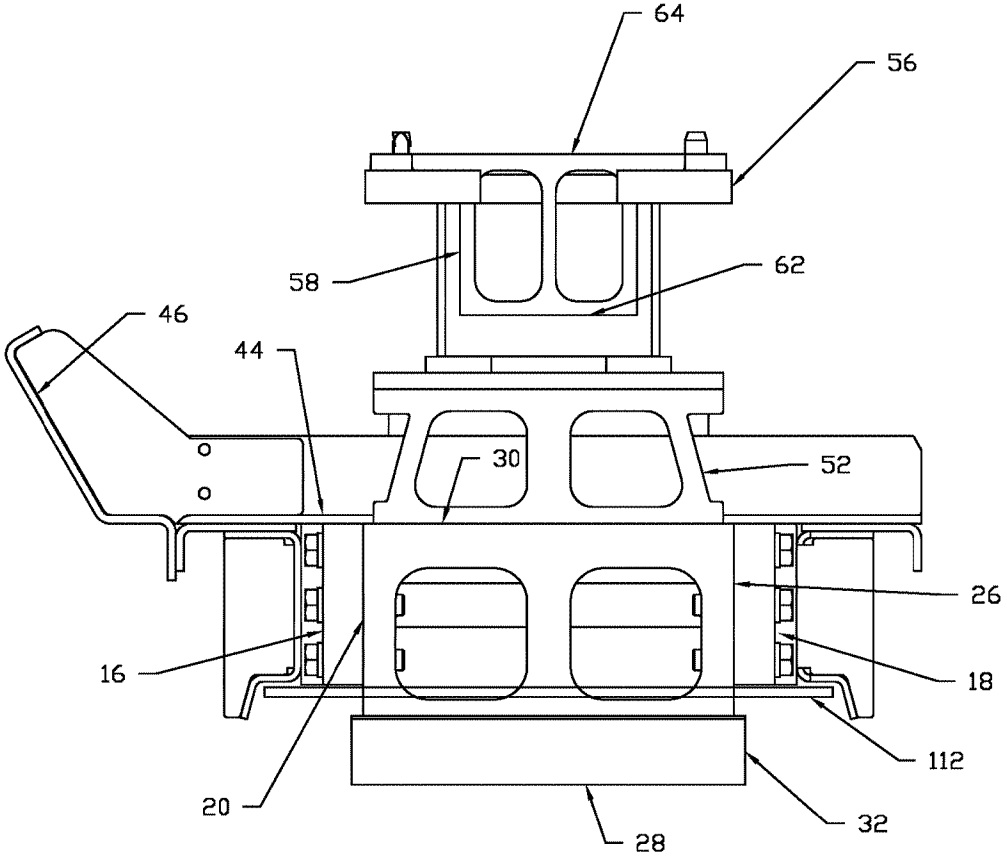
FIG. 4 is a side elevation view of the mold assembly of FIG. 1 shown in a transfer condition.
Figure 5:
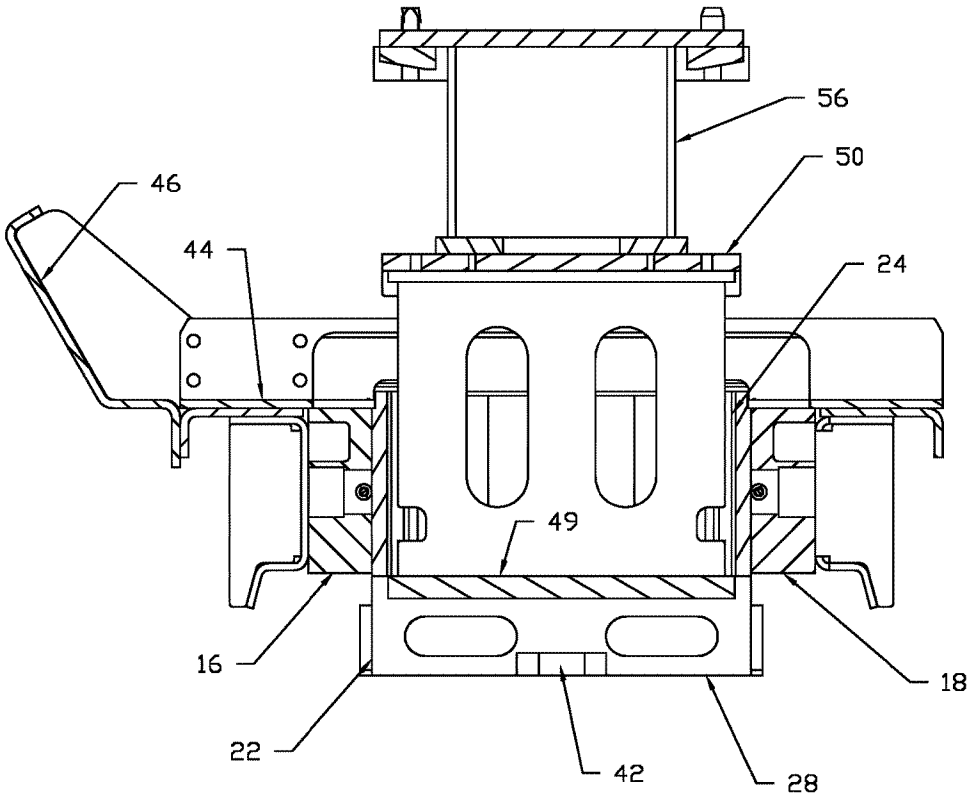
FIG. 5 is a section, side elevation view taken along line 5-5 of FIG. 3 and showing the mold shoes received within the mold cavities.

When the mold assembly 10 is to be removed from the CPM, the stop blocks 114, 116 are retracted by pneumatic actuation or rotated out of the way and head assembly 14 lowered by compression beam 102 onto the mold box 12 until the mold transfer stops 52, 54 come in contact with the top of the mold box. As the stop block surfaces are moved out of the way from contact with the compression strip stops, the head assembly 14 is able to fully lower onto the mold box 12 as shown in FIG. 4. The head assembly 14 is then decoupled from the compression beam 102, as by removing clamps 104, 106 and the mold box 12 and head assembly 14 then lifted from the shelves 132, 134, and from the alignment dowel 136 (FIG. 8) on the shelves, from below and transferred in a transfer plane outward from the concrete products forming machine (here out from the page).

Figure 8:
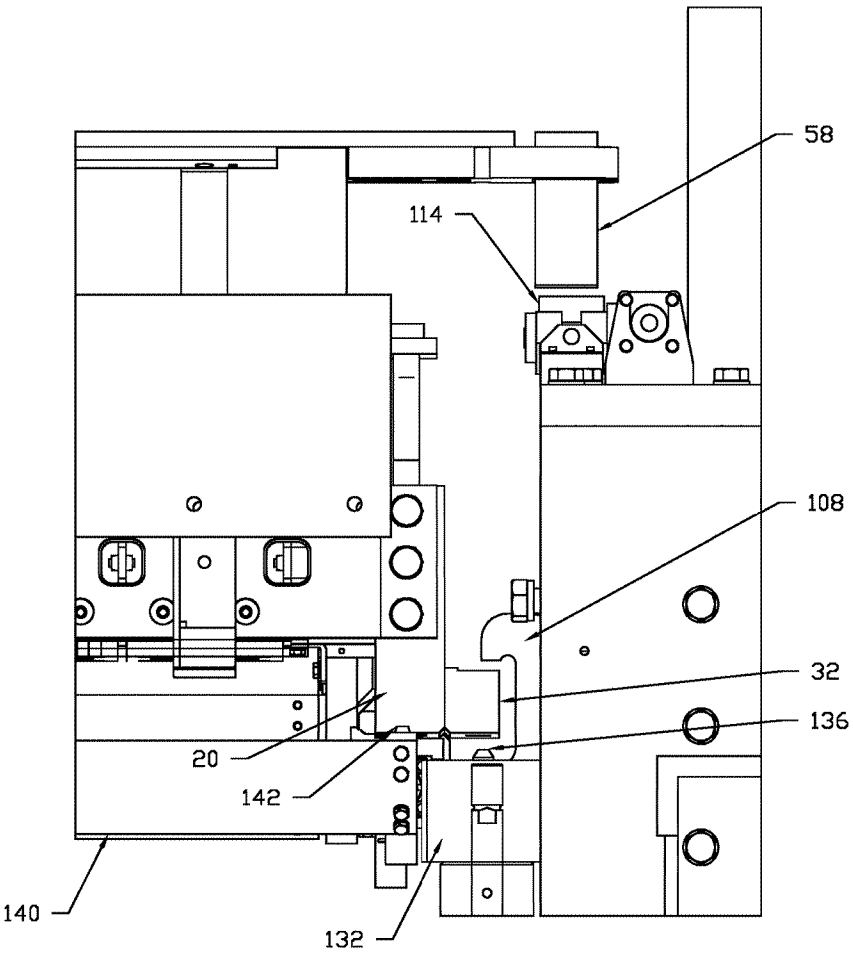
FIG. 8 is a front elevation showing the mold assembly of FIG. 1 demounted from shelves of a concrete products forming machine (CPM) by an extractor.

FIG. 8 illustrates this mold removal process where a mold extractor device 140 moves out of the plane of the page between shelves 132, 134 and underneath the mold side walls 20. 24. The extractor lifts upward so that a tapered alignment block 142 is received within the complementary mold transfer locator 40 formed in the underside of the mold box side walls. The extractor continues to lift upward until the mounting bracket extensions 32, 34 of the mold box are lifted from the alignment dowels 136 on the mounting shelves 132, 134. The mold may then be moved out from the CPM to a mold transfer station where the first mold can be exchanged with a second mold and the extractor places the mold on the CPM shelves in a reverse step so that the alignment dowels are received within the die alignment holes and the mold transfer locators are exposed from below inward of the shelves.

Having described and illustrated the principles of the invention in a preferred embodiment thereof, it should be apparent that the invention can be modified in arrangement and detail without departing from such principles. We claim all modifications and variation coming within the spirit and scope of the following claims.

What is claimed is:

1. A mold assembly for forming concrete products comprising:

a mold box having cavities disposed between side walls of the mold box for receiving and molding concrete products;

a head assembly having multiple shoes aligned within the mold box cavities and slots formed on outside upper surfaces thereof;

compression strip stop brackets slidably received in each of the slots to enable tool less insertion and removal of the compression strip stop brackets from the head assembly and configured to contact stop block surfaces on the concrete products forming machine during a product forming process;

a mounting bracket extension coupled to each of the side walls of the mold box and forming a lower mounting surface of the mold assembly configured to mount to shelves of a concrete products forming machine;

die alignment holes formed in an underside of each mounting bracket extension and configured to receive alignment dowels extending upward from shelves of the concrete products forming machine;

mold transfer locators formed in an underside of each of the sidewalls inward of the die alignment holes and shelves of the concrete products forming machine and configured to locate the mold assembly onto mold extractor arms when the mold assembly is lifted off of the alignment dowels by the mold extractor arms during a mold extraction process.

2. The mold assembly of claim 1, further including:

transfer stop brackets downwardly directed from side walls of the head assembly, and configured to contact side walls of the mold box and suspend the shoes within the cavities at a designated lower height.

3. The mold assembly of claim 1, each of the compression strip stop brackets having an upper flared section wider than the head assembly slots so that the lower section inserts through the slot and the upper flared section sits atop the head assembly.

4. A mold assembly for forming concrete products comprising:

a mold box having a body with a front wall and a back wall joined together with side walls and having cavities for receiving and molding the concrete products, the side walls each having a side face that spans between a bottom facing surface of the side face and a top facing surface;

the front and back walls of the mold box sized for extending substantially between a pair of shelves on a concrete product forming machine allowing the mold assembly to sit directly on top of the shelves, the mold box including die alignment holes extending up from the bottom facing surface for slidingly receiving a respective alignment dowel extending up from the shelves thereby holding the mold box in a prealigned position before coupling the mold box to the shelves;

a head assembly having multiple shoes shaped for slidingly inserting through a top side of the mold box into the cavities for compressing the concrete products into a molding condition and pushing the molded concrete products out a bottom side of the mold box, the shoes slidingly removable back out the top side allowing the mold box to receive and mold additional concrete products;

transfer stop brackets downwardly directed from side walls of the head assembly, and configured to contact side walls of the mold box and suspend the shoes within the cavities at a designated lower height; and compression strip stop brackets downwardly directed from side walls of the head assembly having a terminating lower surface disposed above and outside of the transfer stop brackets and configured to contact a bumper surface on the concrete products machine prior to the transfer stop brackets contacting the mold box during a molding process.

5. The mold assembly of claim 4, wherein the head assembly includes slots formed on outside upper surfaces thereof, the compression strip stop brackets slidably received in each of the slots to enable tool less insertion and removal of the compression strip stop brackets from the head assembly.

6. The mold assembly of claim 5, each of the compression strip stop brackets having an upper flared section wider than the head assembly slots so that the lower section inserts through the slot and the upper flared section sits atop the head assembly.

7. The mold assembly of claim 4, further including mold transfer locators positioned inwardly of the die alignment holes of the mold box and the shelves on the concrete product forming machine, the mold transfer locators configured to locate the mold assembly onto mold extractor arms when the mold assembly is lifted off of the alignment dowels by the mold extractor arms during a mold extraction process.

8. The mold assembly of claim 7, wherein the mold transfer locators each include a recess that interfaces with complimentary structures on the mold extractor arms.

9. The mold assembly of claim 4, further including mold bracket extensions coupled to the side walls and depending outward therefrom to define a lower mounting surface that sits directly on top of the shelves.

10. The mold assembly of claim 9, wherein the die alignment holes are defined through the lower mounting surface of the mold bracket extensions, further including mold transfer locators positioned inwardly of the die alignment holes and configured to locate the mold assembly onto mold extractor arms when the mold assembly is lifted off of the alignment dowels by the mold extractor arms during a mold extraction process.

11. A mold assembly for forming concrete products comprising:

a mold box having cavities disposed between side walls of the mold box for receiving and molding concrete products;

a head assembly having multiple shoes aligned within the mold box cavities;

transfer stop brackets downwardly directed from side walls of the head assembly, and configured to contact the side walls of the mold box and suspend the shoes within the cavities at a designated lower height;

a mounting bracket extension coupled to each of the side walls of the mold box and forming a lower mounting surface of the mold assembly configured to mount to shelves of a concrete products forming machine;

die alignment holes formed in an underside of each mounting bracket extension and configured to receive alignment dowels extending upward from shelves of the concrete products forming machine;

mold transfer locators formed in an underside of each of the sidewalls inward of the die alignment holes and shelves of the concrete products forming machine and configured to locate the mold assembly onto mold extractor arms when the mold assembly is lifted off of the alignment dowels by the mold extractor arms during a mold extraction process.

12. The mold assembly of claim 11, further including compression strip stops located outside the shoes and configured to contact stop block surfaces on the concrete products forming machine during a product forming process.

13. The mold assembly of claim 12, wherein the head assembly includes slots formed on outside upper surfaces thereof, the compression strip stop brackets slidably received in each of the slots to enable tool less insertion and removal of the compression strip stop brackets from the head assembly.

14. The mold assembly of claim 13, each of the compression strip stop brackets having an upper flared section wider than the head assembly slots so that the lower section inserts through the slot and the upper flared section sits atop the head assembly.

* * * * *